US008840298B2

(12) United States Patent
Stegemoeller et al.

(10) Patent No.: US 8,840,298 B2
(45) Date of Patent: Sep. 23, 2014

(54) CENTRIFUGAL MIXING SYSTEM

(75) Inventors: Calvin Stegemoeller, Duncan, OK (US); Max Phillippi, Duncan, OK (US); Stanley Stephenson, Duncan, OK (US); Herb Horinek, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 606 days.

(21) Appl. No.: 12/360,871

(22) Filed: Jan. 28, 2009

(65) Prior Publication Data

US 2010/0188926 A1 Jul. 29, 2010

(51) Int. Cl.

| | |
|---|---|
| ***B01F 15/02*** | (2006.01) |
| ***B01F 5/00*** | (2006.01) |
| ***B01F 5/10*** | (2006.01) |
| ***E21B 21/06*** | (2006.01) |
| ***B01F 5/16*** | (2006.01) |
| ***B01F 3/12*** | (2006.01) |
| ***B01F 7/16*** | (2006.01) |

(52) U.S. Cl.

CPC ..... *B01F 3/1221* (2013.01); *E21B 21/062* (2013.01); *B01F 5/104* (2013.01); *B01F 5/16* (2013.01); *B01F 3/1271* (2013.01); *B01F 7/1625* (2013.01)

USPC ..... 366/136; 366/137; 366/159.1

(58) Field of Classification Search

CPC ..... B01F 15/02; B01F 3/08; B01F 3/0861; B01F 3/088; B01F 3/12; B01F 3/1271; B01F 5/10; B01F 5/102; B01F 5/106; B01F 5/108; B01F 2003/1285

USPC ..... 366/136, 137, 159.1

See application file for complete search history.

(56) References Cited

U.S. PATENT DOCUMENTS

| | | | |
|---|---|---|---|
| 3,326,536 | A | 6/1967 | Zingg et al. |
| 4,239,396 | A | 12/1980 | Arribau et al. |
| 4,460,276 | A | 7/1984 | Arribau et al. |
| 4,490,047 | A | 12/1984 | Stegemoeller et al. |
| 4,808,004 | A | 2/1989 | McIntire et al. |
| 4,850,702 | A | 7/1989 | Arribau et al. |
| 5,904,419 | A | 5/1999 | Arribau |
| 6,193,402 | B1 | 2/2001 | Grimland et al. ..... 366/14 |
| 6,974,246 | B2 | 12/2005 | Arribau et al. |
| 7,048,432 | B2 | 5/2006 | Phillippi et al. |
| 7,334,937 | B2 | 2/2008 | Arribau et al. |

(Continued)

FOREIGN PATENT DOCUMENTS

| | | |
|---|---|---|
| CA | 2500500 A1 | 9/2006 |
| DE | 419812 | 10/1925 |

(Continued)

OTHER PUBLICATIONS

PCT Search Report in Application No. PCT/GB2010/000114, Sep. 3, 2010.

(Continued)

*Primary Examiner* — Richard Crispino
*Assistant Examiner* — Matthew Hoover
(74) *Attorney, Agent, or Firm* — John W. Wustenberg; Baker Botts L.L.P.

(57) ABSTRACT

A mixing system may include a closed mixer having an inlet, a discharge, and an inlet/discharge. The mixing system may also include a recirculation line in fluid communication with the inlet and the inlet/discharge.

15 Claims, 3 Drawing Sheets

(56) References Cited

U.S. PATENT DOCUMENTS

| | | | | |
|---|---|---|---|---|
| 7,353,875 | B2 | 4/2008 | Stephenson et al. | |
| 2002/0154567 | A1* | 10/2002 | Husher | 366/132 |
| 2004/0218463 | A1 | 11/2004 | Allen | 366/164.6 |
| 2005/0201197 | A1* | 9/2005 | Duell et al. | 366/136 |
| 2007/0137862 | A1 | 6/2007 | Stephenson et al. | |
| 2007/0258317 | A1 | 11/2007 | Arribau et al. | |

FOREIGN PATENT DOCUMENTS

| | | | | |
|---|---|---|---|---|
| DE | 880888 | | 5/1953 | |
| EP | 0 511 788 | A1 | 11/1992 | E21B 43/26 |
| GB | 346837 | | 4/1931 | |
| GB | 1500901 | A | 2/1978 | |
| JP | 10033961 | | 2/1998 | |
| NL | 6614200 | | 4/1968 | |
| SU | 1664383 | | 7/1991 | |

OTHER PUBLICATIONS

PCT Search Report in Application No. PCT/GB2010/000114, Jan. 26, 2010.

* cited by examiner

CENTRIFUGAL MIXING SYSTEM

BACKGROUND

The present invention relates to mixers and, more particularly, in certain embodiments, to mixers for blending particulates, or fluid into a fluid stream.

Traditional oil field fracturing blenders are open top mixing systems that require sophisticated fluid control systems to maintain a nominal level of fluid in a mixing tub. The typical open tub fracturing blender in oil field services utilizes an atmospheric pressure open top blending vessel to blend particulates with carrier fluid (usually a viscous polymer fluid system). The level of the fluid in the blending vessel is controlled by various control valves and level sensors through proprietary computer software control systems. Although advancements have been made in providing a rugged, tough, responsive fluid level system, the system is still a major cause of critical equipment failures on the fracturing blenders. In order to eliminate these components and systems, centrifugal type, closed system blenders have been used.

The typical centrifugal blending system utilizes a minimal volume mixer case to collect particulates and carrier fluid and redirect them to the mixer discharge. These systems typically use a combination centrifugal force impeller to inject the particulates and provide carrier fluid under pressure to the mixer. In addition to creating pressure, the centrifugal force on the carrier fluid in the mixer prevents the carrier fluid from exiting the mixer. The particulates enter the mixer at an eye of a rotating impeller, which provides motive force to move the particulates into the mixer and prevent the pressurized carrier fluid from escaping to the atmosphere. The carrier fluid section or the mixer impeller must provide sufficient flow at the pressure required by high-pressure downhole pumps (typically 50 to 75 psi). The particulates section of the pump impeller must be able to inject particulates into the pressurized mixer and keep the carrier fluid contained. In some cases, an external boost pump (such as a low pressure, high volume axial flow pump) is used to provide efficient suction characteristics to keep the carrier fluid section of the mixer impeller primed. However, these high mix pressures, which require a high mixer rpm, may cause severe erosion on mixer rotating components due to the high velocities of abrasive fluids.

Generally, the centrifugal mixer volume is kept small to minimize required wall thickness (required by the typical operating pressure range of 50-70 psi.), along with associated weight and cost. For example, for 50-70 psi operating pressure, the volume of the mixer is typically less than two barrels. This small volume prevents significant dwell times. For example, at 50 barrels per minute, the dwell time of a 2 barrel volume is less than 2.5 seconds. Thus, when abrupt changes occur in the carrier fluid (e.g. slurry or water) supply or particulate delivery rate, (i.e., sand-off, empty frac tank, etc), the concentration of particulates in the mixer can become extremely high or low before the control system can properly respond to the abrupt change. Thus, fluctuations in the carrier fluid delivery system (e.g., the slurry delivery system and/or the water supply system), or the particulate delivery system can be catastrophic, even causing the entire fracturing job to fail, requiring extensive rework.

Further, when throughput is slowed, and the fluid velocity drops below the minimum particle carrying velocity, there is a tendency for the particulates to "fall out" of the carrier fluid. When downhole rate stops, the mixer may deadhead under mixing pressure, and any slurry in the mixer will tend to separate. This necessitates a flush of the mixer before mixing is stopped, so that there is a clean fluid plug when mixing resumes. Additionally, getting particulates into the mixer vanes may be very difficult. Particulates are directed from vertical to horizontal and accelerated to enter the vanes. Thus, the vanes are either very deep or inducer vanes are used. Finally, this design lacks an atmospheric pressure tub to provide for removal of entrained air in the downhole pressure piping, necessitating a connection to an external holding tank to allow the high pressure pumping units to "prime-up" or recirculate fluid to remove entrapped air.

SUMMARY

The present invention relates to mixers and, more particularly, in certain embodiments, to mixers for blending particulates, or fluid into a fluid stream.

In some embodiments, a mixing system may comprise a closed mixer having an inlet, a discharge and an inlet/discharge, and a recirculation line in fluid communication with the inlet and the inlet/discharge.

In some embodiments, a mixing system may comprise a closed mixer, and an averaging volume attached to the closed mixer.

The features and advantages of the present invention will be readily apparent to those skilled in the art. While numerous changes may be made by those skilled in the art, such changes are within the spirit of the invention.

DETAILED DESCRIPTION OF THE DRAWINGS

The present invention relates to mixers and, more particularly, in certain embodiments, to mixers for blending particulates, or fluid into a fluid stream.

Figure 1:
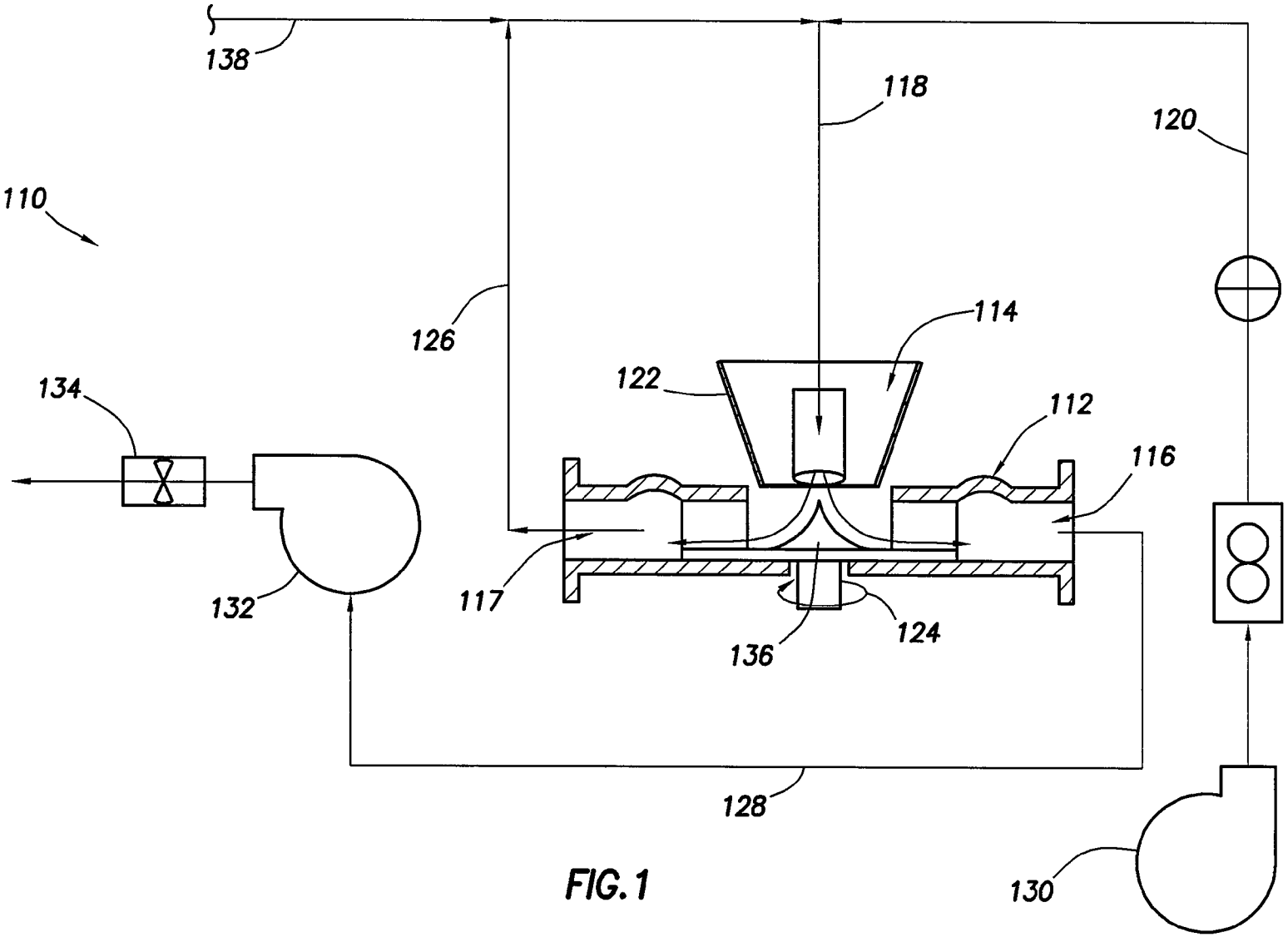
FIG. 1 illustrates a schematic of one embodiment of a mixing system.

Referring to FIG. 1, mixing system 110 may include mixer 112 having inlet 114, discharge 116, and inlet/discharge 117. Carrier fluid may be introduced into mixer 112 via inlet line 118, which is in fluid communication with inlet 114. Carrier fluid may enter inlet line 118 via pressurized line 120. Particulates may also enter mixer 112 via inlet 114. Particulates may be introduced to inlet 114 via particulate delivery system 122. As particulates and carrier fluid enter the mixer 112, centrifugal force provided by a drive 124 causes them to mix and form a slurry. The slurry may then exit the mixer 112 through the discharge 116. Mixer housing 112 may be fluidly connected to recirculation line 126 via inlet/discharge 117. A predetermined portion of the slurry may enter recirculation line 126 for delivery to inlet 114 via inlet line 118, while a remaining portion of the slurry enters a discharge line 128. Recirculation line 126 allows the slurry to enter mixer 112 for additional mixing and/or reduction in entrained air.

Also illustrated in FIG. 1 is suction pump 130 useful to supply a pressurized stream of carrier fluid through pressurized line 120 to inlet line 118. Suction pump 130 may be adjusted to increase or decrease the pressure/volume of carrier fluid supplied to the mixer. Optional booster pump 132 may be used to direct slurry in discharge line 128 through a densometer 134 and to high pressure pumping equipment.

Depending on the application, all of the slurry may enter the recirculation line 126, or all of the slurry may enter the discharge line 128. For instance, at no-thru-put conditions, the pressure exerted by mixer 112 will overcome the set pressure provided by suction pump 130 and mixer 112 will recirculate the slurry. When thru-put occurs, fluid pressure at inlet/discharge 117 is reduced, and suction pump pressure will dominate and provide carrier fluid to inlet line 118 to keep the dynamic loop full. Inlet/discharge 117 may function as an inlet when inlet 114 does not pass enough fluid at a set pressure of suction pump 130. At job start up, high pressure pumping equipment may use the mixing system to prime-up by circulating fluid through prime-up line 138 to mixer 112 where entrained air can be allowed to escape. This mixing system 110 may allow mixing at low rates, even with large diameter piping (low downhole rates) due to the recirculating feature. The recirculation flow allows the mixer volume to remain active and avoid stagnation of the slurry. In some embodiments, when optional booster pump 132 is used, mixer 112 may operate at low mixing pressure and/or have a lower mixer speed, allowing for decreased mixer wear.

Figure 2:
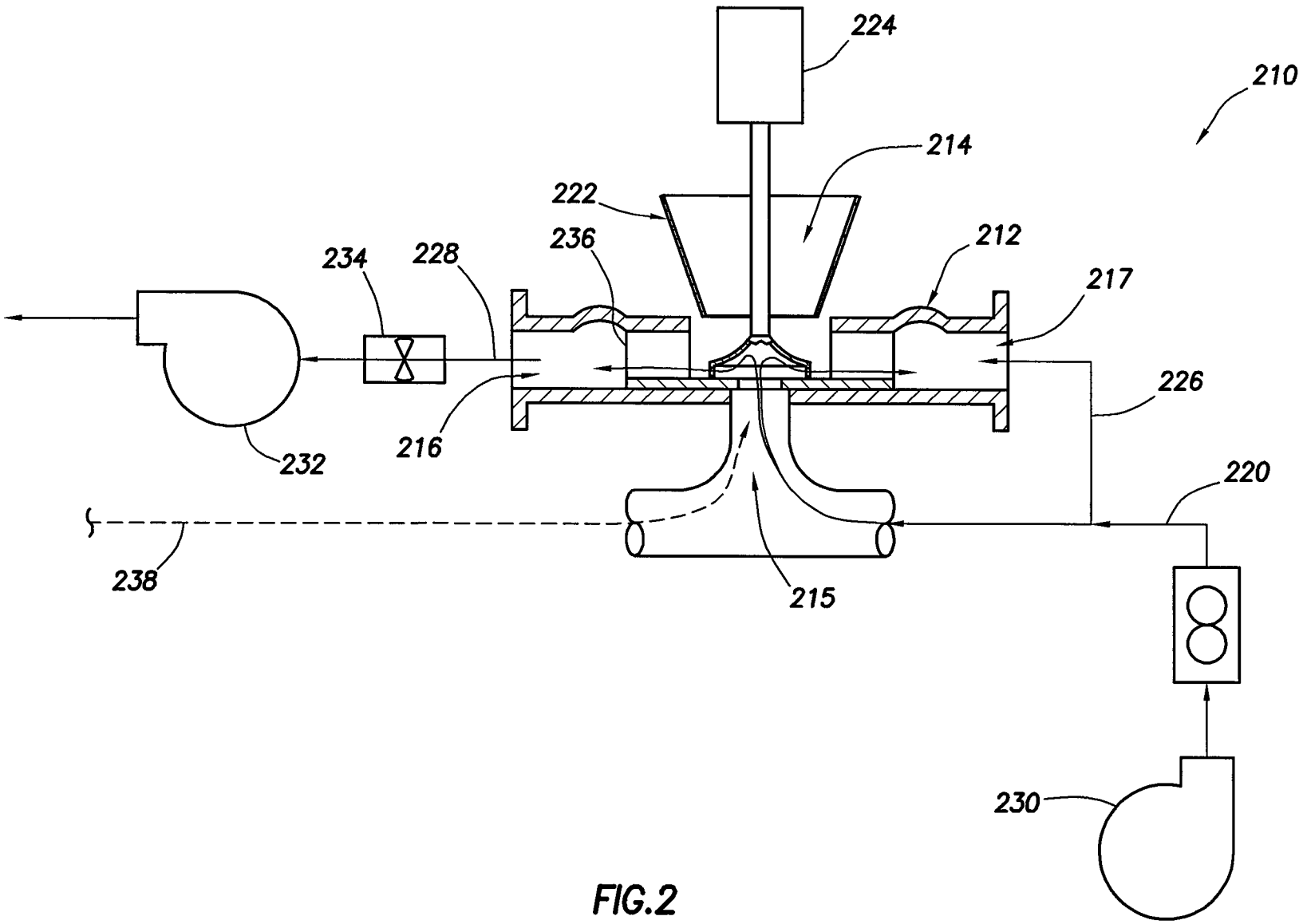
FIG. 2 illustrates a schematic of an alternate embodiment of a mixing system.

Referring now to FIG. 2, an alternate embodiment of mixing system 210 may include mixer 212 having top inlet 214, bottom inlet 215, and discharge 216. Carrier fluid may be introduced into mixer 212 at atmospheric pressure via inlet 215 or under pressure via recirculation line 226. Carrier fluid may enter inlet 215 or recirculation line 226 via pressurized line 220. Particulates may enter mixer 212 via inlet 214. Particulates may be introduced to inlet 214 via optional particulate delivery system 222. As particulates and carrier fluid enter the mixer 212, centrifugal force provided by top drive 224 causes them to mix and form a slurry. The slurry may then exit the mixer 212 through discharge 216. Discharge 216 may be fluidly connected to discharge line 228. A predetermined portion of the slurry may enter recirculation line 226 for delivery to inlet/discharge 217, while a remaining portion of the slurry enters discharge line 228. Recirculation line 226 allows the slurry to enter mixer 212 for additional mixing and/or reduction in entrained air. Inlet/discharge 217 may function as an inlet when inlet 215 does not pass enough fluid at a set pressure of suction pump 230. Inlet/discharge 217 may function as an outlet when thru-put is diminished and pressure at inlet/discharge 217 exceeds a set pressure of suction pump 230. Thus, when pressure in mixer 212 is lower than a set pressure of suction pump 230, clean fluid will enter mixer 212 via inlet/discharge 217, rather than bypassing mixer 212.

Also illustrated in FIG. 2 is suction pump 230 useful to supply a pressurized stream of carrier fluid through pressurized line 220 to inlet 215 at atmospheric pressure. Suction pump 230 may be adjusted to increase or decrease the pressure/volume of carrier fluid supplied to the mixer. Optional booster pump 232 may be used to direct slurry in discharge line 228 through a densometer 234 and to high pressure pumping equipment.

Depending on the application, all of the slurry may enter the recirculation line 226, or all of the slurry may enter the discharge line 228. For instance, at no-thru-put conditions, the pressure exerted by mixer 212 will overcome the set pressure provided by suction pump 230 and mixer 212 will recirculate the slurry. When thru-put occurs, fluid pressure at inlet/discharge 217 is reduced, and suction pump pressure will dominate and provide carrier fluid to inlet 215 to keep the dynamic loop full. At job start up, high pressure pumping equipment may be used to prime-up the system by introducing pressure to prime-up line 238, which in turn may introduce pressure to recirculation line 226.

As illustrated in FIG. 2, drive 224 may have a "top drive" configuration which allows the height of inlet 214 to be reduced. In particular, the lack of an inlet line on the top allows for inlet 214 to be low enough for particulates to be fed directly from a mountain mover or gathering conveyor, without the need for a dedicated particulate delivery system 222. Additionally, inlet 215 on bottom of mixer 212, and corresponding removal of the inlet line from the top of mixer 212 provides additional space, allowing access for additional particulates to be introduced through inlet 214, enhancing particulate ingesting rates. For example, the open area at the top of mixer 212 may allow for the passage of 100 $ft^3$/min. Placement of drive 224 above mixer 212 eliminates the need for a shaft seal between the pressurized area inside mixer 212 and the atmosphere. Such seals are generally a concern when pumping any abrasive slurry. In this embodiment, however, the rotation of impeller 236 provides a dynamic seal between the pressure inside mixer 212 and the atmosphere above.

This mixing system 210 may allow mixing at low rates, even with large diameter piping (low downhole rates) due to the recirculating feature. The recirculation flow allows the mixer volume to remain active and avoid stagnation of the slurry. In some embodiments, when optional booster pump 232 is used, mixer 212 may operate at low mixing pressure and/or have a low mixer speed, allowing for decreased mixer wear.

Figure 3:
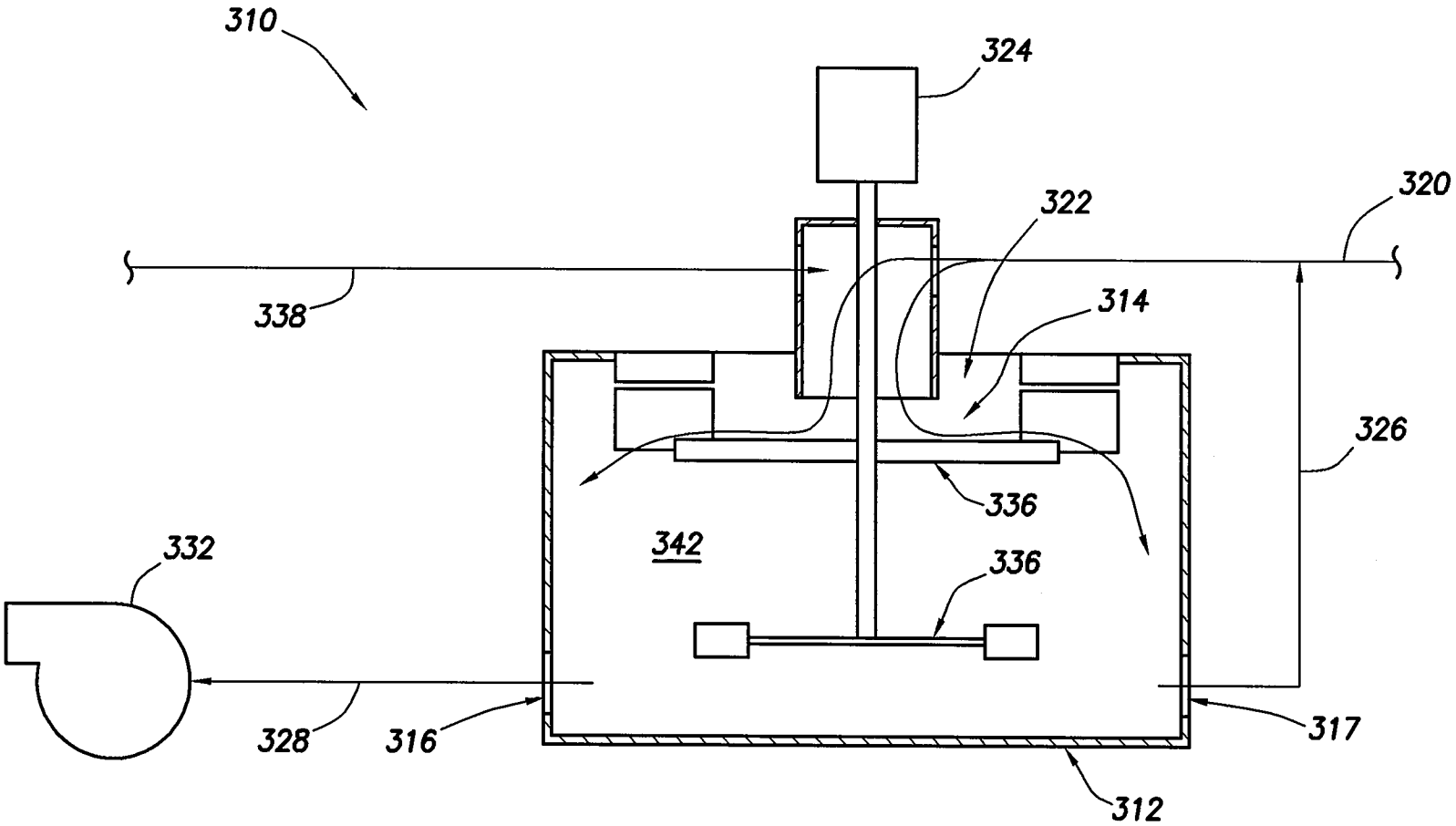
FIG. 3 illustrates a schematic of yet another embodiment of a mixing system.

Referring now to FIG. 3, an alternate embodiment of mixing system 310 may include mixer 312 having inlet 314, discharge 316, and inlet/discharge 317. Carrier fluid may be introduced into mixer 312 via inlet 314 or inlet/discharge 317 which may operate as indicated above with reference to FIGS. 1 and 2. Carrier fluid may enter inlet 314 via pressurized line 320. Particulates may also enter mixer 312 via inlet 314. Particulates may be introduced to inlet 314 via optional particulate delivery system 322. As particulates and carrier fluid enter the mixer 312, centrifugal force provided by top drive 324 causes them to mix and form a slurry. The slurry may then exit the mixer 312 through discharge 316. Mixer 312 may be fluidly connected to recirculation line 326 and mixer inlet/discharge 317. A predetermined portion of the slurry may enter recirculation line 326 for delivery to inlet 314, while a remaining portion of the slurry enters discharge line 328. Recirculation line 326 allows the slurry to enter mixer 312 for additional mixing and/or reduction in entrained air, along with other advantages apparent to a person skilled in the art. Optional discharge pump 232 may be used to direct slurry in discharge line 328 through a densometer and to high pressure pumping equipment.

Depending on the application, all of the slurry may enter the recirculation line 326, or all of the slurry may enter the discharge line 328. For instance, at no-thru-put conditions, the pressure exerted by mixer 312 will overcome the set pressure provided by pressurized line 320 and mixer 312 will recirculate the slurry. When thru-put occurs, fluid pressure at recirculation line 326 is reduced, and pressurized line 320 will dominate and provide carrier fluid to inlet 314 to keep the dynamic loop full. At job start up, high pressure pumping equipment may use the mixing system to prime-up by circulating fluid through prime-up line 338 to mixer 312 where entrained air can be allowed to escape.

Additionally, the embodiment illustrated in FIG. 3 includes an averaging volume 342. In addition to the advantages of the mixer 312 alone, or of the mixer 312 in combination with the recirculation line 326, the averaging volume 342 allows for the slurry to remain in mixer 312 for a period of time. Thus, a fluctuation in the carrier fluid (e.g., slurry or water) delivery system, or the particulate delivery system is not immediately passed to the discharge 316. This may serve to increase tolerance to interruptions in carrier fluid delivery, particulate delivery, or the downhole rate. Instead, the effect of the fluctuation is averaged over a period of time, and passed to the discharge 316 gradually. In other words, averaging volume 342 provides a slurry dwell time to reduce the effect of interruptions in the carrier fluid and particulate supplies.

For example, at a 50 barrel per minute mixing rate, the dwell time of a 2 barrel mixer is less than 2.5 seconds. If the averaging volume 342 were 10 barrels, it would provide an additional dwell time of 12 seconds. Various sizes of averaging volumes 342 may be appropriate. In some embodiments, the total mixer volume, including the averaging volume, may be 50% larger than the volume of a mixer without an averaging volume. In other embodiments, the total mixer volume may be double the volume of the mixer without an averaging volume. In still other embodiments, the total mixer volume may increase by a factor of about 3 or 4 times over the volume of the mixer without an averaging volume. In alternate embodiments, the total mixer volume may be about 5 times the volume of the mixer without an averaging volume. In some embodiments, the averaging volume may be up to 10 barrels or larger. In other embodiments, the total mixer volume may increase as much as tenfold over the volume of the mixer without an averaging volume. In some embodiments, when optional booster pump 332 is used, mixer 312 may operate at low mixing pressure and/or have a low mixer speed, allowing for decreased mixer wear.

The advantages of the "top drive" configuration discussed with respect to the embodiment of FIG. 2 are also applicable to the embodiment illustrated in FIG. 3. While impellers 336 are shown, the lower of the two impellers 336 may be replaced by any of a number of agitators. Additionally, averaging volume 342 is shown as integral, but other configurations may be used, so long as averaging volume 342 is attached to mixer 312.

In the illustrated embodiments, recirculation line 126/226/326 may provide particulate concentration averaging, helping to reduce effects of system disruptions. The recirculation line 126/226/326 may also provide the ability to dead head, or stop downhole rate, while keeping the mixer fluid stream active. Additionally, recirculation line 126/226/326 may help reduce the effects of mixer upset, and allow for prime up on location. Further, the carrier fluid may be injected into an atmospheric pressure area of impeller 136/236/336 rather than into the pressurized volute as is typical with typical centrifugal mixer designs, thus allowing the use of a low pressure/low power carrier fluid supply pump. Additionally, the design of impeller 136/236/336 may expose the carrier fluid stream to the particulates, providing motive force to convey particulates into the impeller vanes. Finally, exposing the carrier fluid and/or the slurry to atmospheric pressure may assist in de-aeration.

As illustrated in the various figures, drive 124 is a bottom drive, and drives 224 and 324 are top drives. However, any of a number of drives may be suitable, as will be appreciated by a person skilled in the art. Likewise, mixers 112, 212, and 312 are illustrated as centrifugal mixers having impeller(s) 136, 236, 336 connected to respective drives 124, 224, 324 via drive shaft. However, this is not intended to be limiting on the invention, and mixers 112, 212, 312 may be progressive cavity pumps or other positive displacement pumps with or without impellers, so long as mixers 112, 212, and 312 are closed (e.g., have fixed volumes and are not at atmospheric pressure). Impellers 136, 236, 336 may likewise be replaced by another source of recirculation or agitation. Similarly, inlets 114, 214, 314, as illustrated, are situated at the eye of a centrifugal mixer. More particularly, the carrier fluid is shown directed onto a nose cone on impellers 136, 236, 336 that divert the fluid velocity from a vertical to a horizontal direction. In these embodiments, as the carrier fluid is converted to a horizontal velocity, the particulates impinge on the carrier fluid stream and are induced into the impeller vanes for expulsion into the mixer case. However, inlets 114, 214, 314, and 215 may be readily modified by one skilled in the art.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by any amount (e.g., 1 percent, 2 percent, 5 percent, or, sometimes, 10 to 20 percent). Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A mixing system comprising:

a closed mixer comprising a single undivided compartment having an inlet, a discharge and an inlet/discharge;

a pressurized line in fluid communication with the inlet, wherein the pressurized line delivers a fluid to the single undivided compartment;

a recirculation line in fluid communication with the single undivided compartment, the pressurized line and the inlet/discharge;

wherein the single undivided compartment selectively directs all of the slurry in the closed mixer to one of the recirculation line and the discharge;

wherein a mixture is prepared in the single undivided compartment; and wherein the mixing system is configured such that flow rate of the mixture through the inlet/discharge line is inversely related to pressure of the fluid in the pressurized line.

2. The mixing system of claim 1, wherein the inlet is in fluid communication with a pressurized line configured to deliver a carrier fluid.

3. The mixing system of claim 1, wherein the inlet is in fluid communication with a delivery system configured to deliver particulates.

4. The mixing system of claim 1, wherein the closed mixer is configured to mix a carrier fluid with particulates to form a slurry.

5. The mixing system of claim 4, wherein the recirculation line is configured to transfer the slurry from the inlet/discharge to the inlet.

6. The mixing system of claim 1, wherein the inlet is a top inlet.

7. The mixing system of claim 1, wherein the inlet is at atmospheric pressure.

8. The mixing system of claim 1, wherein the inlet is a first inlet, and the mixing system further comprises a second inlet, wherein the second inlet is at atmospheric pressure.

9. The mixing system of claim 1, wherein the closed mixer is a centrifugal mixer.

10. The mixing system of claim 1, wherein the closed mixer comprises a bottom drive.

11. The mixing system of claim 1, wherein the closed mixer comprises a top drive.

12. The mixing system of claim 1, wherein the inlet/discharge is in fluid communication with a delivery system configured to deliver particulates.

13. The mixing system of claim 1, wherein the inlet is a first inlet, and the mixing system further comprises a second inlet wherein the recirculation line is fluidly connected to the second inlet and is configured to transfer a slurry from the discharge to the second inlet.

14. The mixing system of claim 13, wherein the first inlet is a bottom inlet.

15. The mixing system of claim 13, wherein the second inlet is a top inlet.

* * * * *